US006724145B1

(12) United States Patent
Muto et al.

(10) Patent No.: US 6,724,145 B1
(45) Date of Patent: Apr. 20, 2004

(54) DISCHARGE LAMP

(75) Inventors: Masaaki Muto, Yokohama (JP); Shigeru Shibayama, Yokohama (JP); Hiroharu Shimada, Tokyo (JP); Isamu Sato, Tokyo (JP); Shinya Omori, Yokohama (JP); Yasuhisa Yaguchi, Yokohama (JP); Naoyuki Matsubara, Yokohama (JP); Yoshifumi Takao, Yokohama (JP); Toshiyuki Nagahara, Yokohama (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/603,431

(22) Filed: Jun. 23, 2000

(30) Foreign Application Priority Data

Jun. 25, 1999 (JP) ..... 11-180285

(51) Int. Cl.[7] ..... H01J 61/00

(52) U.S. Cl. ..... 313/638; 313/643; 313/640; 313/571; 313/620

(58) Field of Search ..... 313/571, 620, 313/634, 639, 570, 573, 580, 574, 640, 643, 638

(56) References Cited

U.S. PATENT DOCUMENTS

| | | | | |
|---|---|---|---|---|
| 4,594,529 A | | 6/1986 | de Vrijer | 313/571 |
| 5,394,057 A | * | 2/1995 | Russell et al. | 313/638 |
| 5,504,392 A | | 4/1996 | Natour et al. | 313/570 |
| 5,691,601 A | * | 11/1997 | Frey et al. | 313/638 X |
| 5,936,350 A | * | 8/1999 | Yoshida et al. | 313/638 X |
| 6,137,230 A | * | 10/2000 | Bora et al. | 313/638 X |
| 6,166,495 A | * | 12/2000 | Newell et al. | 313/638 X |
| 6,265,827 B1 | * | 7/2001 | Takahashi et al. | 313/638 |
| 6,392,346 B1 | * | 5/2002 | Newell et al. | 313/638 X |

FOREIGN PATENT DOCUMENTS

| | | |
|---|---|---|
| EP | 0 386 601 A2 | 9/1990 |
| EP | 0 399 288 A2 | 11/1990 |
| EP | 0 883 160 A1 | 12/1998 |
| JP | 06-111772 | 4/1994 |
| JP | 08-203471 | 8/1996 |
| JP | 11-040102 | 2/1999 |
| JP | 11-102663 | 4/1999 |
| JP | 11-111219 | 4/1999 |
| JP | 2000-164171 A | 6/2000 |

* cited by examiner

*Primary Examiner*—Ashok Patel
(74) *Attorney, Agent, or Firm*—Morgan, Lewis & Bockius LLP

(57) ABSTRACT

The invention provides an arc tube with improved chromaticity and start-up characteristics that does not contain mercury, and provides a vehicle headlamp equipped with a metal halide lamp that contains no mercury in the arc tube. Among other improvements, the evaporation of low melting point metal halides is promoted and the start-up characteristics of the arc tube are improved.

21 Claims, 4 Drawing Sheets

ENLARGED CROSS-SECTION ALONG LINE A-A OF ESSENTIAL PARTS

ENLARGED CROSS-SECTION ALONG LINE A-A OF ESSENTIAL PARTS

DISCHARGE LAMP

This application claims priority to and hereby incorporates by reference Japanese Patent Application No. HEI 11-180285, which was filed on Jun. 25, 1999, and hereby incorporates by reference Japanese Patent Application No. HEI 10-336395 which was filed on Nov. 26, 1998.

BACKGROUND OF THE INVENTION

1. Field of the Invention

The invention relates to a discharge lamp, and more particularly relates to a metal halide lamp that does not contain mercury; The discharge lamp is preferably incorporated in a vehicle headlamp.

2. Description of Related Art

Various types of metal halides are contained in the arc tubes of high-pressure mercury or typical metal halide lamps in order to ensure light emission in the desired spectral distribution. Metal halides are solids at room temperature. When an arc tube wall is heated by an arc discharge, solidified metal halides located at the tube wall vaporize and metal-specific light emissions are obtained.

The temperature of gas and ions within a discharge medium is dependant on the pressure of the medium. The pressure and temperature within the arc tube are therefore high in order to cause the mercury, which is of a relatively high vapor pressure, to vaporize, along with the metal halides. Related metal halide lamps therefore require both inert gases (starter gases) to start discharge, and mercury, in order to create high pressure within the tube and to increase tube wall temperature.

A starter gas is used for starting discharge and usually, argon gas is enclosed within a range of 1 kPa to 10 kPa In this pressure range, the temperature of the rare gases and ions within the discharge portion is not so different from room temperature. The temperature of the walls of the arc tube gradually rises at the start of discharge. In a comparatively short time, the vapor pressure of the mercury rises as the tube wall temperature exceeds 300° C., and a high temperature arc (hot plasma) is generated. The tube wall temperature then rapidly rises and the metal halide vaporizes. When there is no mercury present within the lamp, the tube walls do not heat up until a temperature is reached where the evaporation pressure of the metal halogen compound occurs. Effective luminous flux is therefore not obtained in typical metal halide lamps that do not have mercury.

In recent years, metal halide lamps have begun to require remarkably low power, with 35 W arc tubes being adopted for vehicle headlamps. Vehicle headlamps are required to light-up instantaneously and therefore contain a small amount of xenon gas which is used as a starter gas. The xenon emits light when the lamp is lit, and practically instantaneous illumination can be achieved by generating a thermal plasma from the beginning of power supply so as to rapidly heat the arc tube.

With metal halide lamps for vehicle use, mercury is necessary in order to create a high Lit pressure condition inside of the arc tube and to sufficiently raise the temperature of the tube walls. However, mercury is a toxic material, and if part of the arc tube is damaged, mercury will be leaked into the surrounding environment. Mercury has, however, been widely used in metal halide lamps with no suitable replacement. When such arc tubes are disposed, it is necessary to break up the arc tubes and recover the mercury, which increases costs. In recent years, arc tubes that do not include toxic materials, such as mercury, have become preferred.

Ultraviolet rays are not required in a large number of lighting applications. However, metallic vapor discharge lamps including mercury may cause damage to the subject of illumination as a result of the emission of ultraviolet rays from the mercury. A great deal of work and cost is involved in blocking these ultraviolet rays. Further, while the arc tube is starting up, the arc tube appears tinged with blue and color rendering is poor in a period where the mercury vapor pressure is rapidly rising, which makes limits on the use of mercury unavoidable. Short arc xenon lamps are available as high-intensity discharge lamps that do not include mercury, but lamp efficiency is low at approximately 30 lumens per watt. Thus, these lamps cannot be used in applications where efficiency is important.

SUMMARY OF THE INVENTION

Additional features and advantages of the invention will be set forth in the description that follows, and in part, will be apparent from the description, or may be learned by practice of the invention. The objectives and other advantages of the invention will be realized and achieved by the structure particularly pointed out in the written description and claims hereof as well as the appended drawings.

The invention is directed to a discharge lamp that resolves the aforementioned problems by providing a metal halide lamp where mercury is not enclosed within the arc tube, so that ultraviolet rays are not emitted by the mercury. Thus, it is no longer necessary to block ultraviolet rays, and it is not necessary to dispose of mercury. A discharge lamp can therefore be provided that is cheaper and resolves the problems of related metal halide lamps.

FIG. 4 is a view showing spectral distribution of light emitted by the arc tube, with solid lines showing spectral distribution of light emitted by a prior mercury-free arc tube and the broken lines showing spectral distribution of light emitted by a mercury-containing arc tube. As shown in FIG. 4, with the arc tube containing a metal-halogen compound of scandium iodide and sodium iodide that does not contain mercury, the generation of light in the blue-light band of 404 nm to 435 nm etc. by the mercury no longer occurs, and the blue light wavelength component is weak and deviates out of the white light range of the chromaticity coordinates.

Light sources for vehicle use require that 25% of the rated luminous flux be generated within one second from the start of discharge, and 80% of the rated luminous flux be generated within four seconds from the start of discharge. It is difficult to achieve the flux required after four seconds in the absence of mercury.

It is the object of the invention to provide a metal halide lamp for vehicle use that does not contain mercury so as to improve the chromaticity and start characteristics.

In the invention, a discharge lamp is equipped with a pair of electrodes facing each other in a discharge space within an arc tube. A metal halide and a rare gas are enclosed in the discharge space and the rare gas is enclosed at a high pressure so as to create a hot plasma of high temperature and pressure. The heat capacity and heat loss of the arc tube are suppressed, raising of tube wall temperature is promoted, and the metal halide compound vaporizes in such a manner as to emit light. The metal halide contains at least scandium iodide or sodium iodide.

Here;

$$P/(Q \cdot t) \geqq 0.20$$

where Q is the content volume of the arc tube ($\mu$l), t is maximum wall thickness (mm), and P is pressure of the xenon gas at room temperature (atms).

Moreover;

$$P/S1/S2 \geqq 0.06$$

where S1 is a cross-sectional area of a portion of the greatest internal diameter of the discharge space of the arc tube ($mm^2$), and S2 is a cross-sectional area of material forming the portion of the greatest internal diameter of the arc tube ($mm^2$).

A metal halide lamp with a pair of electrodes projecting in such a manner as to face each other in a discharge space within an arc tube, with mercury not being included in the discharge space, and with a substantially cylindrical arc being generated between ends of the pair of electrodes, is provided. In this metal halide lamp, a buffer gas serving as a starter gas comprising xenon of approximately 7 to 20 atms at room temperature; sodium halide, scandium halide, or a compound thereof; and a low melting point metal halide with a melting point of approximately 400° C. or less are enclosed in the discharge space. As a result, similar light-emitting characteristics as realized in conventional metal halide lamps can be achieved without using any mercury.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

DETAILED DESCRIPTION OF THE PREFERRED EMBODIMENTS

It is an object of the invention to provide a discharge lamp that operates without employing any mercury.

Further, as the discharge lamp of the invention is particularly suited for use as a light source in vehicle headlamps, etc., it is a further object of the invention to provide a discharge lamp capable of combining the characteristics of high-efficiency, long life-span, and instantaneous start-up, etc. A sufficiently high arc tube operating temperature can be obtained without employing mercury by making the arc tube markedly smaller so as to promote temperature rise of the arc tube, and by enclosing xenon gas at a higher pressure than in the related art for use as a starter gas.

Figure 1A:
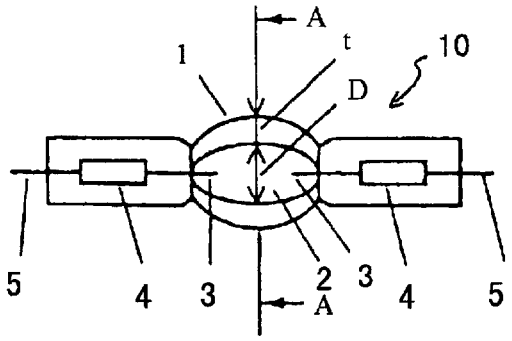
FIG. 1*a* and FIG. 1*b* are a side view of a discharge lamp of an embodiment of the invention, and an enlarged cross-sectional view taken along line A—A of FIG. 1*a*, respectively.

FIG. 1*a* shows a 35 W vehicle discharge lamp made in accordance with the principles of the invention. The lamp can include an arc tube 1 formed of a quartz glass tube and which contains a discharge space 2. A pair of electrodes 3 of a high melting point metal such as tungsten can be embedded in the arc tube such that they project into the ends of the discharge space 2. Foil 4 of, for example, molybdenum, is connected by, for example, welding, to the ends of the electrodes 3 that are located opposite the discharge space 2. Lead wires 5, also of a material such as molybdenum, are then connected to the ends of the foil 4 that are located opposite the discharge space. Certain portions of the electrodes 3 can be connected to the lead wires 5 and are embedded in quartz glass using a method such as pinch sealing. Portions of the electrodes 3 project within the discharge space 2. The discharge space 2 is therefore sealed in an air-tight manner and electrical conduction between the electrodes 3 can take place when the lead wires 5 are supplied with electrical power. The discharge space 2 contains at least one type of metal halide and xenon gas at a pressure of approximately 7 to 20 atms, but does not contain mercury.

The length of the discharge space is preferably 7.1 mm, and the electrodes project into the discharge space a distance of approximately 1.7 mm with a distance between the electrodes being preferably 3.7 mm. The arc tube wall temperature changes dramatically depending on the internal diameter of the arc tube, wall thickness, and xenon gas pressure. The above factors relating to wall temperature change were taken into account to determine methods of heating the tube walls to a temperature necessary for causing the metal halides to vaporize, without employing mercury. Sodium iodide, scandium iodide and xenon gas can be enclosed within the arc tube and the arc tube can be made with the following parameters: content volume of the arc tube Q ($\mu$l), maximum wall thickness t (mm), and xenon gas pressure P (atms). Light output then investigated, with the results being shown in table 1.

TABLE 1

| Units | Maximum Inner Diameter D mm | Maximum Outer Diameter DO mm | Maximum Wall Thickness t mm | Content Volume Q μl | Xe Pressure P atm | Luminous Flux L lm | Voltage V V | Current I A | Power W W | Efficiency E lm/W |
|---|---|---|---|---|---|---|---|---|---|---|
| 1 | 2.734 | 5.981 | 1.640 | 26.31 | 7 | 2082 | 26.8 | 1.23 | 32.96 | 63.16 |
| 2 | 2.793 | 6.006 | 1.612 | 27.70 | 7 | 2150 | 27.3 | 1.29 | 35.22 | 61.05 |
| 3 | 2.741 | 6.012 | 1.649 | 26.77 | 5 | 1771 | 21.4 | 1.50 | 32.10 | 55.17 |
| 4 | 2.719 | 5.980 | 1.653 | 26.21 | 5 | 1754 | 21.8 | 1.46 | 31.83 | 55.11 |
| 5 | 2.694 | 6.000 | 1.663 | 25.43 | 10 | 2689 | 24.3 | 1.35 | 32.81 | 81.97 |
| 6 | 3.102 | 6.884 | 1.951 | 30.54 | 13 | 2391 | 25.7 | 1.36 | 34.95 | 68.41 |
| 7 | 3.090 | 6.856 | 1.961 | 30.68 | 13 | 2357 | 25.4 | 1.30 | 33.02 | 71.38 |
| 8 | 3.188 | 6.870 | 1.880 | 32.64 | 13 | 2626 | 24.2 | 1.34 | 32.43 | 80.98 |
| 9 | 2.372 | 4.906 | 1.275 | 21.54 | 5 | 2695 | 22.5 | 1.48 | 33.30 | 80.93 |
| 10 | 2.327 | 4.908 | 1.307 | 20.99 | 7 | 2597 | 22.8 | 1.42 | 32.38 | 80.21 |
| 11 | 2.327 | 4.910 | 1.298 | 20.67 | 7 | 2633 | 23.6 | 1.38 | 32.57 | 80.85 |
| 12 | 2.321 | 4.911 | 1.303 | 20.50 | 10 | 3042 | 27 | 1.25 | 33.75 | 90.13 |
| 13 | 2.291 | 4.885 | 1.366 | 20.10 | 10 | 3068 | 30.2 | 1.15 | 34.73 | 88.34 |
| 14 | 2.344 | 4.916 | 1.327 | 21.01 | 10 | 2970 | 24.4 | 1.35 | 32.94 | 90.16 |

A visible luminous efficiency of 70 lm/W or more can be discerned from these results. Vaporization of the metal halides can therefore be promoted by using xenon to provide a high-desity thermal plasma and by suppressing the thermal capacity and thermal loss of the arc tube.

Figure 1B:
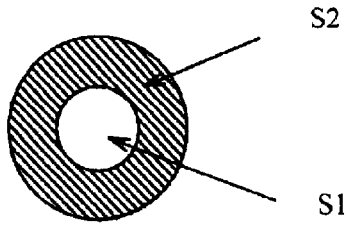

FIG. 1*b* shows a cross section of the arc tube of FIG. 1*a* along line A—A. S1 is the area of the cross section of the discharge space and S2 is the area of the cross section of the arc tube material at A—A.

Figure 2:
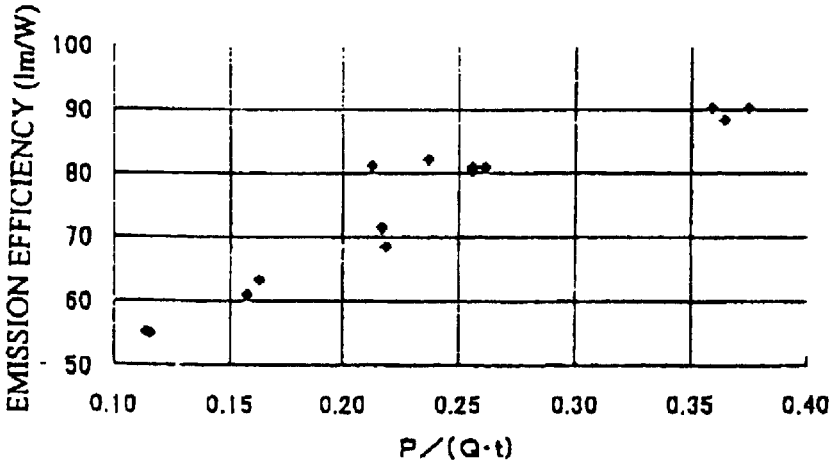
FIG. 2 is a graph indicating arc tube wall temperature of the invention where visible light-emitting efficiency is plotted with respect to a function P/(Q·t) where P is the pressure (atms) of the xenon gas, Q is the arc tube content volume($\mu$l) and t is the maximum arc tube wall thickness (mm)

FIG. 2 plots the visible light-emitting efficiency with respect to a function P/(Q·t), where P is the pressure (atms) of the xenon gas, Q is the arc tube content volume (μL) and t is the maximum arc tube wall thickness (mm). It can be seen that the visible light-emitting efficiency is 70 lm/W or more when the function P/(Q·t) satisfies the relationship of equation (1).

$$P/(Q\cdot t)\geqq 0.20 \qquad \text{equation (1)}$$

The minimum value for P/(Q·t) for generating a practical vapor pressure for the metal halides changes when any one of the shape and length of the arc tube, the power consumed by the arc tube, and the type of metal halide or electrode sealing members are changed. The most suitable values for the maximum diameter of the arc tube, the maximum wall thickness, and the xenon pressure can be found by carrying out the inventive method.

Table 2 shows a discharge space cross-section S1 and an arc tube material cross-section S2 for the portion of the discharge space at the largest internal diameter portion of the arc tube (shown by cross-section A—A in FIG. 1).

TABLE 2

| Sample | Discharge Space Cross-section S1 ($mm^2$) | Arc Tube Material Cross-section S2 ($mm^2$) |
|---|---|---|
| 1 | 5.868 | 22.21 |
| 2 | 6.124 | 22.19 |
| 3 | 5.898 | 22.48 |
| 4 | 5.803 | 22.27 |
| 5 | 5.697 | 22.56 |
| 6 | 7.554 | 29.65 |
| 7 | 7.495 | 29.40 |
| 8 | 7.978 | 29.07 |
| 9 | 4.417 | 14.48 |

TABLE 2-continued

| Sample | Discharge Space Cross-section S1 ($mm^2$) | Arc Tube Material Cross-section S2 ($mm^2$) |
|---|---|---|
| 10 | 4.251 | 14.66 |
| 11 | 4.251 | 14.67 |
| 12 | 4.229 | 14.70 |
| 13 | 4.120 | 14.61 |
| 14 | 4.313 | 14.66 |

Figure 3:
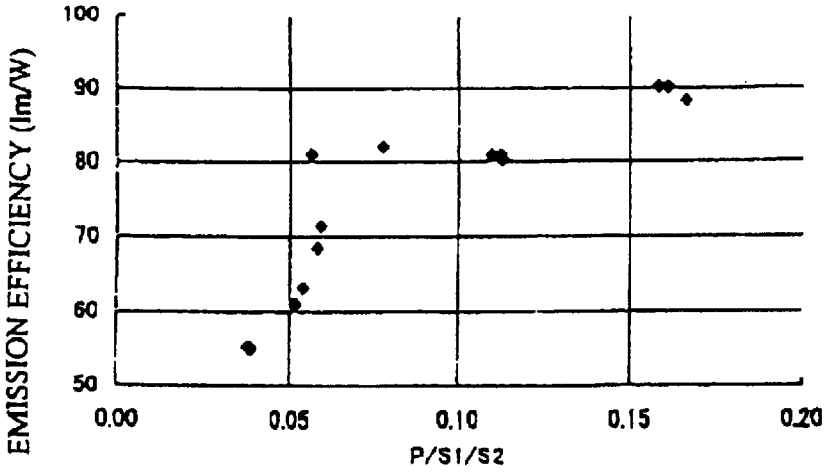
FIG. 3 is a graph in which emission efficiency of the arc tube is plotted with respect to pressure P of the xenon gas within the arc tube at room temperature divided by S1 and S2 for the lamp of FIG. 1*a;*

In FIG. 3, the pressure P of the xenon within the arc tube at room temperature divided by the values for S1 and S2 is plotted against the luminous efficiency of the arc tube. When equation (2) below is satisfied, a high luminous efficiency of 80 lm/W or more can be obtained.

$$P/S1/S2\geqq 0.06 \qquad \text{equation (2)}$$

The tube wall is located closer to the high-temperature arc as the cross-section of the arc tube discharge space becomes smaller, i.e. as the internal diameter becomes smaller. Further, the loss due to thermal conduction is decreased and the heat capacity is reduced as the cross-section of the arc tube material becomes smaller, and the wall temperature rises. The evaporation pressure of the metal halides therefore rises and the amount of visible light generated is increased.

An embodiment of the invention is shown in FIG. 1. The maximum outer diameter of the arc tube is approximately 6.00 mm, the maximum inner diameter is approximately 2.70 mm, the content volume is approximately 25.4 μl, the maximum wall thickness is approximately 1.65 mm, the arc tube length is approximately 7.1 mm and the distance between the electrodes is approximately 3.7 mm. The ratio by weight of sodium H e iodide to scandium iodide is approximately 3:1, giving a total of 0.4 mg, and the xenon gas is enclosed at 10 atms. Accordingly;

$$P/(Q\cdot t)=0.239$$

and the relationship of equation (1) is satisfied. Further, if S1=5.723 ($mm^2$) and S2=22.54 ($mm^2$), then $$P/S1/S2=0.078$$

and the relationship of equation (2) is also satisfied.

Figure 4:
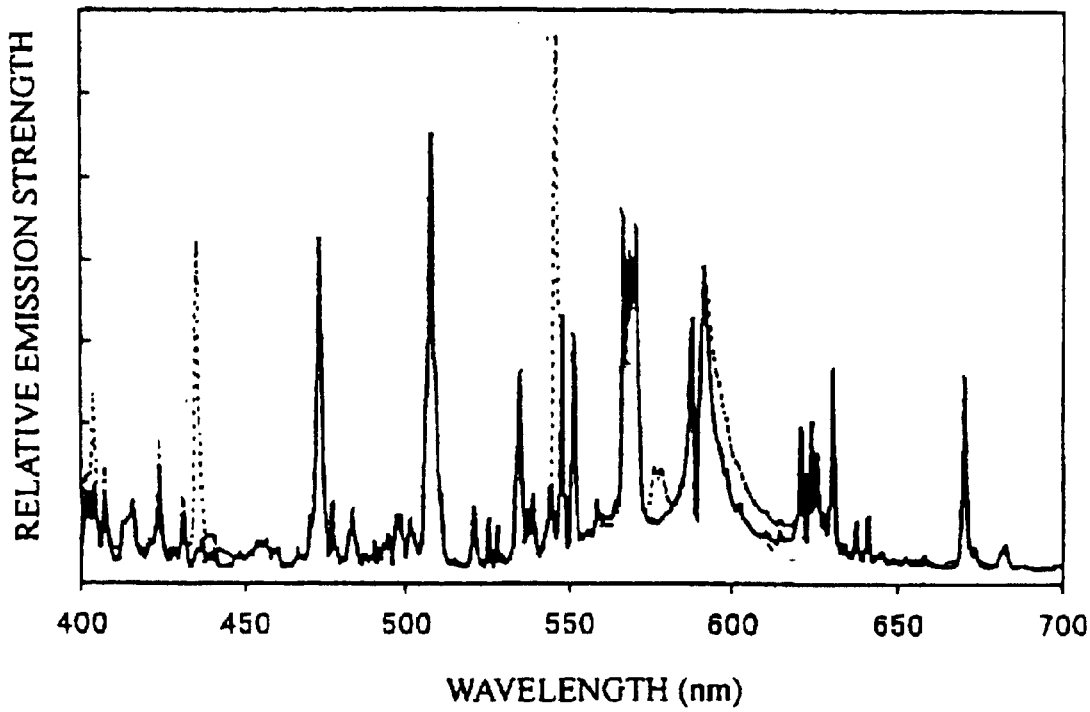
FIG. 4 is a graph that shows spectral distribution of light emitted when the discharge lamp of prior art is illuminated (solid lines), and spectral distribution of light emitted when a discharge lamp containing mercury is illuminated (broken lines)

FIG. 4 shows the spectral distribution of light emitted when the arc tube is lit. Spectral distribution of an arc tube including mercury is also shown by broken lines in FIG. 4 for comparison. As shown, the same metal evaporation luminescence realized by the related arc tube which includes mercury can be obtained with the mercury-less arc tube of the invention. The principle emission characteristics are shown in table 3.

TABLE 3

| Characteristic | Unit | Arc Tube Containing Mercury | Mercury-less Arc Tube |
|---|---|---|---|
| Lamp Input | W | 35 | 35 |
| Lamp Voltage | V | 85 | 28 |
| Total Luminous Flux | lm | 3150 | 2910 |
| Lamp Efficiency | lm/W | 90 | 83 |
| Average Color Rendering Evaluation Number (Ra) | | 65 | 64 |

When discharge commences, a high-temperature arc is formed due to the xenon gas, and an amount of light exceeding 25% of the rated luminous flux is emitted by the xenon gas. The luminous flux emitted directly after the start of discharge depends on the pressure at which the xenon gas is enclosed in the arc tube. When the charging pressure is approximately 7 atms or less at room temperature, 25% of the rated luminous flux cannot be reached. When the charging pressure of the xenon gas at room temperature is greater than approximately 20 atms, the pressure during operation of the arc tube exceeds 120 atms, which is approaching the upper pressure limit for the arc tube which is approximately 240 atms.

A metal halide lamp 10 of the invention includes metal halides of sodium halide and scandium halide or compounds thereof, preferably with melting points of 400° C. or less. A combination of sodium and scandium halides is preferred, as these materials emit light over almost the entire spectrum of visible light wavelengths and therefore emit white light in a highly efficient manner.

The low melting point metal halides compensate for insufficiencies in the light flux during the period from the starting of discharge until the sodium and scandium effectively generate luminous flux by evaporating and thermally decomposing within the high-temperature arc plasma. Light emitted by the metals rapidly gets stronger from a location where the temperature of the coldest parts of the arc tube rises so as to reach the approximate melting points of the metal halides. The high-pressure discharge lamp of the invention includes metal halides with melting points of 400° C. or less, so that the emission of light by enclosed metal halides becomes stronger later, at the stage where the temperature of the coldest parts of the arc tube 1 reaches 400° C. or less.

The addition of low melting point metal halides in the arc tube 1 dramatically promotes an increase in the temperature of the wall of the arc tube 1. The reason for this is thought to be that the metal halides thermally decompose within the high temperature arc, and that surplus energy present during recombination of the metal halides dissipates in the vicinity of the relatively low-temperature wall.

A region between the ends of the electrodes 3 which face each other across the internal diameter of the arc tube 1 can have a length that is in a range of approximately 0.6 mm to 1.7 mm larger than the arc diameter. The length by which the electrodes 3 project into the discharge space 2 can be from approximately 1.0 mm to 1.7 mm.

With metal halide lamp arc tubes for vehicle use, arc diameter indicates the range down to 20% of maximum luminance, and an arc diameter of 1.1 mm is preferred. When the arc diameter is 1.1 mm, which is smaller than an internal diameter of 1.7 mm of the arc tube at the region between the ends of the electrodes 3, a heat dissipation region can no longer be guaranteed. The heat dissipation region causes temperature to fall from approximately 2500° C. at the high temperature region at the periphery of the arc to approximately 1000° C. at the quartz glass tube wall. The extent of electrical ionization is therefore reduced due to the arc being cooled by the tube wall, which causes instability and makes it easy for the arc to disappear. The quartz glass tube wall is therefore subjected to overheating. In addition, a chemical reaction may take place between the metal halides and the quartz glass tube wall, and evaporation of the silica may cause devitrification or melting of the arc tube itself.

When the internal diameter of the arc tube 1 is greater than 2.8 mm, the upper part of the arc is displaced due to the counteractive effects of gravity operating on the arc. The temperature of the coldest part of the arc tube 1 at the bottom of the arc tube 1 therefore falls, and a rapid rise in evaporation pressure is no longer desired even if low melting point metal halides are employed.

The arc diameter can be controlled using the pressure of the xenon gas, the halogen partial pressure and the input power of the arc tube 1, etc. Similar results can be obtained even when the appropriate diameter for the arc is other than the above by making the internal diameter of the arc tube at the region between the ends of the opposing electrodes 3 from approximately 0.6 mm to 1.7 mm larger than the diameter of the arc.

When the electrodes 3 project within the discharge space 2 by a distance of less than approximately 1.0 mm, electrons emitted from the electrodes 3 are dispersed in the direction of the tube wall. Thus, the proportion of electrons that are lost becomes large, and discharge d) becomes unstable. When the electrodes project more than approximately 1.7 mm, the temperature in the vicinity of the portions of the electrodes 3 that are embedded in the quartz glass wall falls, so that metal halides are therefore deposited on these portions, and rapid evaporation of the metal halides therefore does not occur.

The temperature of the coolest parts of the arc tube can be made to be 400° C. or more within four seconds from starting the discharge, and a luminous flux exceeding 80% of the rated luminous flux can be successfully emitted by optimizing the combination of the xenon gas and metal halides and optimizing both the internal diameter of the arc tube 1 and the distance between the electrodes 3 projecting within the discharge space 2.

By selecting metal composing the low melting point metal halides with ionizing potentials in a range of 5.5 eV to 6.5 eV, highly efficient emission of light is not hindered from the start of sodium and scandium emissions due to the increased temperature of the arc tube, and emissions from metals composing the low melting point metal halides can be attenuated. This is because a phenomena is utilized where, when a plurality of gas atoms or molecules with differing ionizing potentials are present, the molecules or atoms with the smaller ionizing potentials are ionized or recombined, or energized and recombined, and thermal energy of the arc plasma is converted to and emitted as light, whereas it is relatively difficult to make atoms or molecules with a high ionizing potential emit light.

It is preferable for the ionizing potential of metal composing the low melting point metal halide to be between that of sodium (5.14 eV) and scandium (6.54 eV) in order to emit a certain amount of light when the arc tube 1 is operating in a stable manner, with 5.5 to 6.5 eV being preferred. Either of indium (5.79 eV) or gallium (6.00 eV) would satisfy this condition.

Chlorine, bromine and iodine can be selected for use as the halogens which make up the metal halides. However, iodine is the most appropriate as this will cause the least corrosion to metal materials such as tungsten of which the electrodes are formed. Indium or gallium are particularly preferred as metals for the low melting point metal halides. Indium emits light at wavelengths of 410 nm and 451 nm, and gallium emits light at wavelengths of 403 nm and 417 nm. Emissions in the blue waveband are therefore made stronger and emission characteristics are improved.

The melting point of these iodides is 359° C. for indium iodide, and 214° C. for gallium iodide. These iodides are therefore preferred for evaporation in the start-up period in order to increase the initial luminous flux. However, there is a tendency for scandium emissions, where the ionizing potential is relatively high, to be hindered when large amounts of indium iodide and gallium iodide are added, thus limiting the amount of indium iodide and gallium iodide that can be added.

Tin iodides have a melting point of 320° C. and a continuous spectrum that is emitted over the entire visible range, so that a superior emission of white light can be obtained when starting up the arc tube 1. However, iodides also emit a molecular emission spectrum that extends into the infra-red band. Thus, the amount of iodides that can be added is limited because if a large quantity of iodides are added, the visible light-emitting efficiency decreases.

With regard to the composition of the metal halides in the metal halide lamp of the invention, the mole ratio of sodium halide to scandium halide can be approximately 1.0 to 15, and the molar ratio of low melting point metal halide to scandium halide can be approximately 0.1 to 10, or more preferably, 0.5 to 3.0.

It is well known that when, for example, iodine is used as the halogen, sodium iodide and scandium iodide form a halide compound ($NaScI_4$) and vapor pressure is markedly increased. As a result, almost all of the vapor containing sodium and scandium that is created during the operation of the arc tube 1 forms the halide compound. The small amount of scandium halide content is therefore very important, but a certain range of sodium halide content is permissible.

When the mole ratio of sodium halide to scandium halide is less than 1, the partial pressure of sodium within the arc falls and the color emitted takes on a blue hue. Conversely, when the mole ratio is greater than 15, a large amount of sodium halide remains unvaporized on the tube wall during operation of the arc tube 1. The unvaporized sodium halide blocks and scatters light, causing unevenness in the light distribution of the light source and a decrease in Li emission efficiency.

When the mole ratio of the low melting point metal halide to the scandium halide is less than 0.5, the start-up characteristics and color of light emitted do not improve sufficiently. When this mole ratio is greater than 3.0, light emitted by metals comprising the low melting point metal halide becomes predominant, causing the light emitted to deviate from the desired color range and causing the visible light emitting efficiency to noticeably drop.

When the metal halide lamp 10 of the invention is employed as a light source in a vehicle headlamp, it is preferable for the metal halide lamp 10 to be driven by an alternating current or direct current of 100 W or less. The invention is advantageous in the respect that light separation problems seldom occur where different colors are emitted in the vicinity of an anode and cathode when the arc tube 1 is driven by a direct current because there is no mercury in the lamp.

The metal halide lamp of the invention also has several additional advantages. For example, when indium iodide (InI) or tin iodide ($SnI_2$) is used as the low melting point metal halide, a free halogen capturing effect occurs. Scandium halide emits a large number of line spectra in the visible spectrum and is therefore superior as a material for emitting visible light. However, scandium halide also reacts with the quartz glass of the arc tube 1 to produce scandium silicate and free halogen. When the arc tube 1 contains mercury, the free halogen reacts with the mercury to produce mercury halide, but in the mercury-free arc tube the halogen remains as is. Electrons easily attach to the halogen, and when there is an excessive amount of halogen, this causes the start-up voltage of the lamp to rise, thus making the discharge unstable. The free iodine can be removed by the indium iodide (InI) and tin iodide ($SnI_2$) reacting with the free iodine so as to form molecules of $InI_2$~$InI_3$ and $SnI_3$~$SnI_4$ with larger iodine numbers. Thus, the aforementioned start-up and stability problems can be resolved.

Another advantage of the invention is improvement in the durability of the arc tube end seals. As shown in FIG. 1, the rod-shaped electrodes 3 of tungsten etc. are embedded in the quartz glass and connected with the metal foil 4. However, the tungsten etc. and the quartz glass do not completely fit due to a difference in their thermal expansion coefficient, and a slight gap therefore occurs. This quartz that forms this gap is at a lower temperature than the discharge space 2 within the arc tube 1 and is therefore permeated with luminescent material, which then solidifies. In the case of the related mercury metal halide lamp, mercury immediately permeates into this gap when the arc tube 1 is extinguished. The mercury then vaporizes due to a rapid rise in temperature when the arc tube 1 is subsequently turned on, so that an extremely large pressure is created in the gap. When the arc tube 1 is repeatedly turned on and off, cracks can occur in the quartz glass portion due to the extremely large pressures at the gap, and leaks may occur in the arc tube 1 causing the metal halide lamp to no longer illuminate.

In the case of the arc tube 1 that contains sodium iodide and scandium iodide (and no mercury), an iodide compound of the relatively low melting point sodium and scandium permeates into the gap. The vapor pressure of this halide compound is much smaller than that of mercury and the halide compound therefore remains in the gap either in solid or liquid form when the arc tube 1 is illuminated. A dramatically large pressure is therefore not generated, and the occurrence of cracks in the quartz glass portion is prevented, improving the durability of the arc tube seal.

However, as described above, the emission characteristics of this type of arc tube are greatly influenced by the amount of iodide compound and it is therefore preferable for the halide compound not to permeate into the gap.

In the invention, a low melting point metal halide is also added in addition to the sodium and scandium halides. The low melting point metal halide therefore enters into the gap first, suppressing entry of the halide compound into the gap. The indium iodide and tin iodide have higher vapor pressures than the halide compound of sodium and scandium and do not cause the substantial pressures that are caused by mercury. Thus, the metal halide lamp of the invention improves the durability of the seal.

Luminous flux maintenance of the arc tube is also improved by the invention. A relatively substantial drop in luminous flux occurs 100 hours from the start of illumination when an arc tube 1 containing sodium and scandium halides is used. The principle causes of this are as follows: a reduction in the amount of scandium contributing to the emission of light due to the scandium halide and quartz glass reacting to produce scandium silicate; a suppression of the emission of light at the edges of the arc due to free electrons becoming attached to simultaneously created free halogens; and a reduction in the halide compound contributing to the emission of light due to the halide compound entering into the gap where the electrodes are sealed. However, in the invention, luminous flux maintenance of the arc tube is improved because the generation of free halogens and the entry of halogen compound into the gap with the electrodes are suppressed.

The arc tube voltage is raised in the metal halide lamp of the invention by adding low melting point metal halide. The reason for this is considered to be that voltage loss due to elastic collisions of electrons is increased due to an increase in the atomic density of metal within the arc and thus the drop in arc voltage is increased. The arc tube current can therefore be made smaller because of the rise in the arc tube voltage, and luminous flux maintenance can be improved because deterioration of the electrodes is suppressed. Power supply apparatus can also be made smaller and more cheaply because loss due to the generation of heat by a drive supply can be suppressed.

Xenon gas, sodium iodide, scandiun iodide and indium iodide can be enclosed within an arc tube at a pressure of 10 atms at room temperature, as in the example of an arc tube shown in FIG. 1. A total of 0.5 mg of metal halide is contained in the arc tube which has a content volume of 23 $\mu$l at a mole ratio of sodium iodide to scandium iodide of 8.5 and a mole ratio of indium iodide to scandium iodide of 2.0. The length of the region of the arc tube across which the pair of electrodes face each other is a minimum of approximately 2.1 mm and a maximum of approximately 2.3 mm, and is preferably 1.0~1.2 mm larger than an arc diameter of 1.1 mm. The ends of the electrodes protrude into the discharge space by a distance of approximately 1.6 mm, and the distance between the ends of the electrodes is preferably 3.8 mm.

Figure 5:
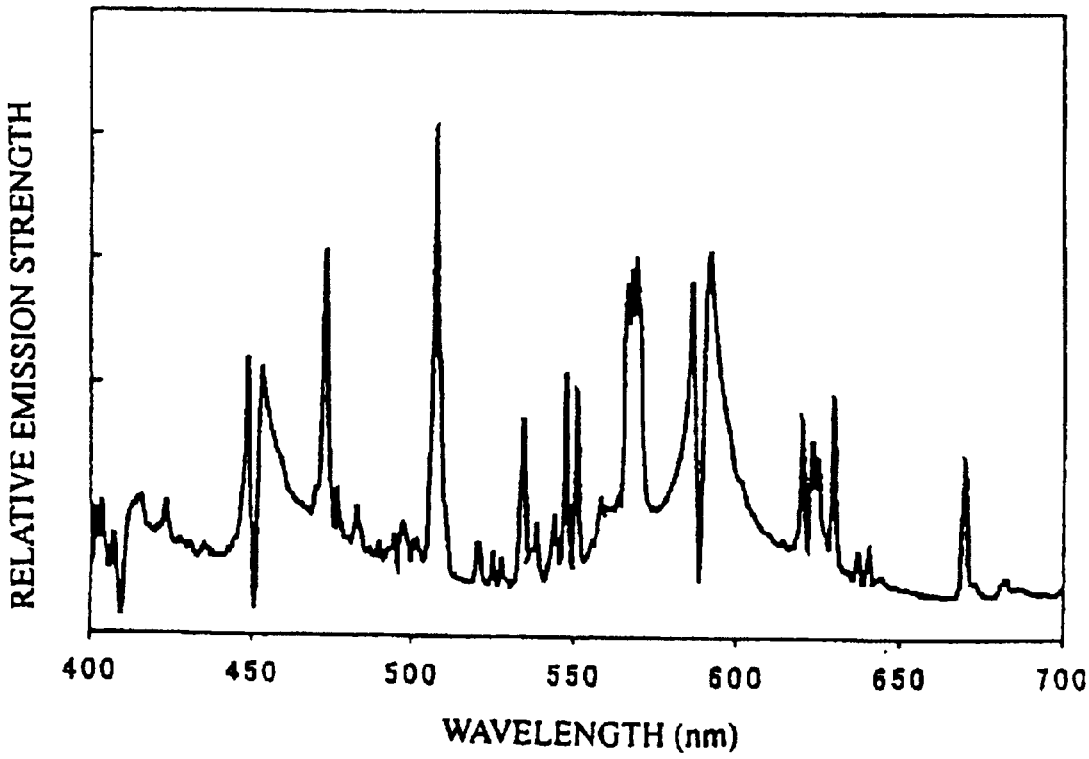
FIG. 5 is a graph showing spectral distribution of light emitted by an arc tube of an embodiment of a metal halide lamp made in accordance with the principles of the invention.

FIG. 5 shows spectral distribution of light emitted by an arc tube of this embodiment of the invention. Here, a continuous spectrum of indium appears on the short wavelength side, while a combination of a continuous spectrum of sodium and a multi-line spectrum of scandium appears on the long wavelength side. Thus, an ideal spectral distribution of light can be obtained for this white light source. When the arc tube input power is 35 W, the total light flux is 2950 lumens, the visible luminous efficacy is approximately 84 lumens/watt, the average color rendering evaluation number Ra is 74, the CIE chromaticity coordinates are x=0.352, y=0.338, and the correlated color temperature is 4650 K.

Figure 6:
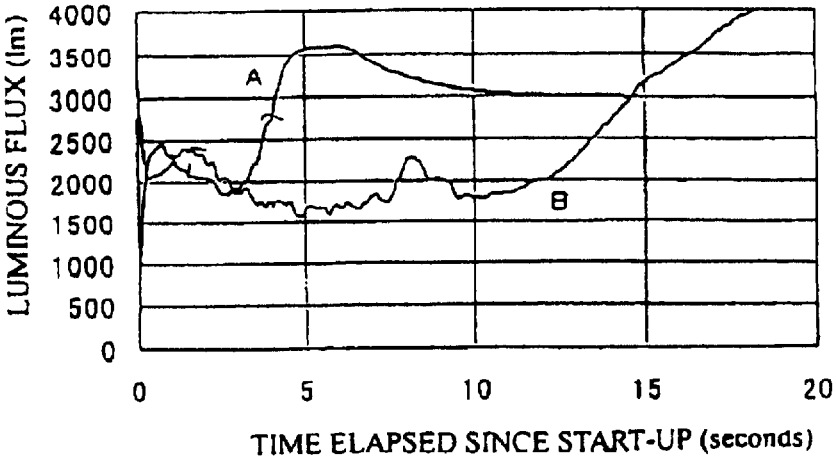
FIG. 6 is a graph showing luminous flux start-up characteristics for the arc tube of the embodiment of the invention used to create FIG. 5.

FIG. 6 shows luminous flux characteristics vs. time for an arc tube during start-up that is similar to the arc tube used to create FIG. 5. Curve "A" shows a luminous flux start-up characteristic for the arc tube used to create FIG. 5. Curve "B" shows a luminous flux start-up characteristic for an arc tube configured similar to the arc tube used to create FIG. 5, with the exception that the low melting point metal halide is not included. It can be seen from FIG. 4 that the luminous flux in the period from three to fifteen seconds after start-up is increased by adding the low melting point metal halide and that a start up characteristic that has sufficient luminous flux for practical use can be provided.

Arc tube voltage during the stable operation of the arc tube used to create curve "A" is approximately 44.1 V, and current is approximately 0.79 A, while the voltage for the arc tube used to create curve "B" is approximately 27.3 V and the current is approximately 1.28 A. In both cases, the start-up luminous flux can be promoted by causing a maximum current of approximately 2.6 A to flow during the start-up period.

Figure 7:
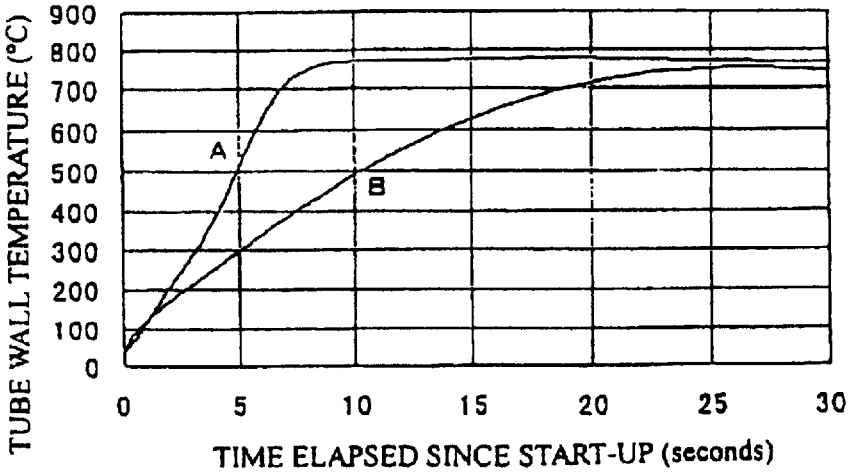
FIG. 7 is a graph showing the temperature of the coldest part at the lower part of the arc tube at start-up for the embodiment of the invention used to create FIG. 5.

FIG. 7 graphs measurements for the temperature of the coolest part at the lower part of the arc tube vs. time at start-up for the arc tube used to create FIG. 6. The rise in temperature of the tube wall is substantially quicker for the arc tube that includes a low melting point metal halide and which is used to create curve "A" than for the arc tube used to create curve "B" which does not include any low melting point metal halide. The arc tube used to create curve "A" includes a low melting point metal halide with a melting point of 400° C. or less. A sufficient luminous flux is therefore emitted within four seconds or less when the wall temperature exceeds 400° C. In the arc tube used to create curve "B", the sodium and scandium iodide compound melts when the wall temperature becomes 600° C. or more and a sufficient luminous flux is therefore not started up until after approximately 14 seconds from start-up. The addition of the low melting point metal halide therefore operates in two ways: to cause luminous flux to be emitted at a relatively low wall temperature and to promote the increase of tube wall temperature. These operations then act together to bring about a rapid start-up of luminous flux.

Figure 8:
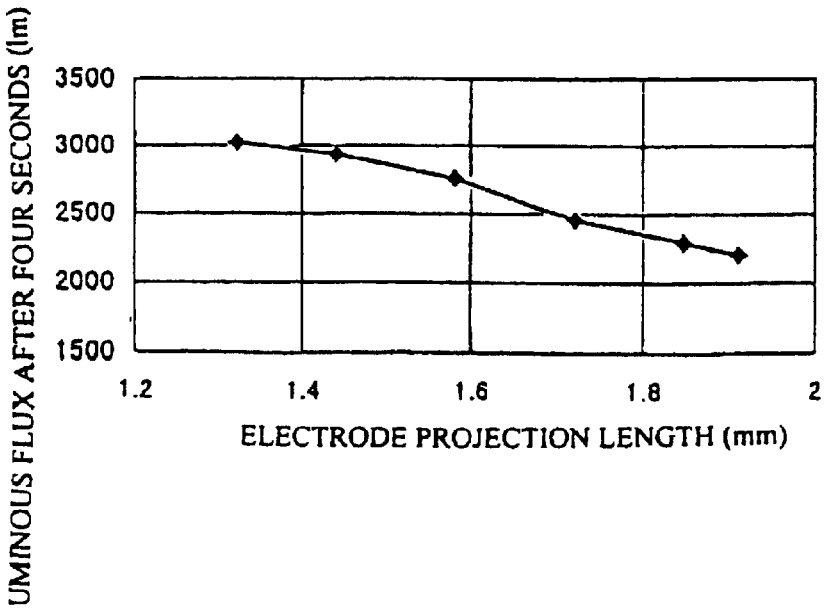
FIG. 8 is a graph showing the relationship between the length of projection of electrodes into an arc tube and the luminous flux four seconds from start of discharge for an embodiment of the invention.

FIG. 8 is a graph showing the relationship between projection length of the electrodes vs. luminous flux at four seconds from start of discharge for an arc tube of the same configuration as for the above embodiment, with the exception that the distance by which the ends of the electrodes project into the discharge space differs. The start up luminous flux can be improved by using electrodes that project into the discharge space approximately 1.7 mm or less.

The above embodiment incorporates indium halide in the arc tube, but similar results can be obtained by adding gallium halide or tin halide.

The metal halide lamp of the invention can also be driven using direct current by modifying the design of the electrodes.

Figure 9:
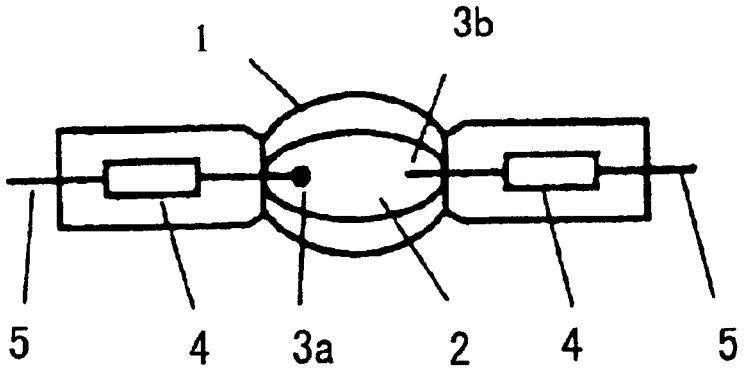
FIG. 9 is a side view of another embodiment of a discharge lamp of the invention.

FIG. 9 shows another embodiment of the invention in which the arc tube 1 is provided with an anode 3*a* and a cathode 3*b* that differ in shape and size and are provided at the tips of the electrodes 3. The arc tube. 1 is driven by direct current. With the exception of the electrodes, the arc tube 1 and the enclosed materials, etc. are substantially the same as for the embodiment shown in FIG. 1. As can be seen from table 4, the emission characteristics of the arc tube of the embodiment of FIG. 9 are substantially the same as the emission characteristics when the arc tube is driven by an alternating current.

TABLE 4

| Characteristic | Unit | No Mercury Arc Tube With Direct Current |
|---|---|---|
| Lamp Input | W | 35 |
| Lamp Voltage | V | 27 |
| Total Luminous Flux | lm | 2850 |
| Lamp Efficiency | lm/W | 81 |
| Average Color Rendering Evaluation Number (Ra) | | 63 |

Use of direct current when the functions of the anode and the cathode are separate is preferable because arc tube voltage is low and current is relatively high for the mercury-less arc tube compared to the mercury-containing arc tube.

Figure 10:
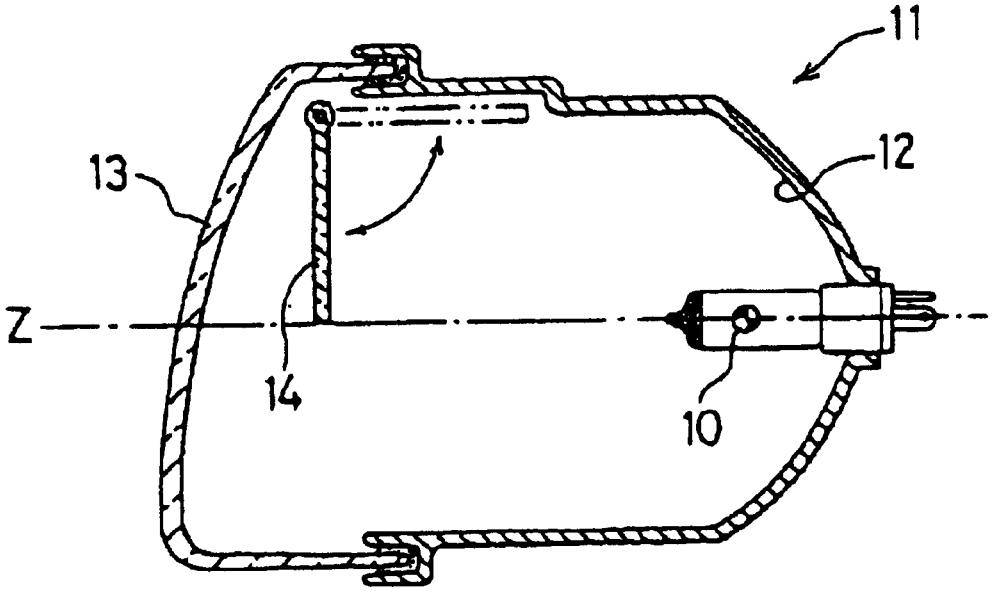
FIG. 10 is a longitudinal side view of a vehicle headlamp equipped with a metal halide lamp of the invention.

FIG. 10 is a longitudinal side view of a headlamp 11 in which the metal halide lamp 10 of the invention is employed as a light source for the vehicle headlamp 11 such as used in an automobile. The headlamp 11 lights up the path in front of the vehicle by reflecting light from the metal halide lamp 10 by a reflector 12 located on a horizontal axis Z so that the reflected light projects towards the front and passes through an outer lens 13. An inner lens 14 can be used to refract light from the reflector 12 downwards and for diffusing this light to the left and right. When the inner lens 14 is in the substantially vertical position, the light distribution is suitable for passing other vehicles (low beam mode), with the area close to the front of the vehicle primarily being lit up. When the inner lens 14 is rotated upwards so as to be substantially horizontal, areas at a distance from the front of the vehicle can be lit up (high beam mode).

By this invention, a high-efficiency discharge lamp can be provided that does not employ toxic mercury. The invention responds to ever-more-pressing requirements to prevent the spread of toxic materials.

Several modification to the structure and components of the disclosed embodiments are within the scope and spirit of the disclosed invention. For example, when the arc tube of the invention is driven using direct current, it is preferable for the tip of the electrode on the anode-side to be spherical and to be large. Further, it is possible to replace the xenon gas with a mix of gases other than xenon, for example, neon and/or argon, etc. could be mixed in with the xenon. This makes it possible to increase the lamp voltage and the lamp efficiency.

The addition of low melting point metal halide to the metal halide lamp of the invention brings about various advantages such as the improvement of start-up, discharge stability, luminous flux maintenance characteristics, durability of the arc tube seal, and electrical characteristics of the arc tube.

It will be apparent to those skilled in the art that various modifications and variations can be made without departing from the spirit or scope of the invention. Thus, it is intended that the invention cover the modifications and variations of the disclosed embodiments of the invention provided they come within the scope of the appended claims and their equivalents.

What is claimed is:

1. A discharge lamp, comprising:

an arc tube having a discharge space including substantially no mercury;

a pair of electrodes facing each other in the discharge space; and a low melting point metal halide with a melting point less than or equal to approximately 400° C. and a rare gas enclosed at high pressure in a range of approximately 7–20 atms in the discharge space in such a manner as to create a hot plasma at a high temperature and pressure, promote an increase in tube wall temperature, and vaporize the metal halide to emit light.

2. The discharge lamp of claim 1, wherein the rare gas includes xenon.

3. The discharge lamp of claim 1, wherein the metal halide includes scandium iodide and sodium iodide.

4. The discharge lamp of claim 1, wherein

P/(Q·t) is approximately equal to or larger than 0.20 where Q represents a content volume of the arc tube in $\mu$l, t represents a maximum wall thickness in mm, and P represents a pressure of the rare gas at room temperature in atms.

5. The discharge lamp of claim 4, wherein the rare gas includes xenon and the metal halide includes scandium iodide and sodium iodide.

6. The discharge lamp of claim 1, wherein

P/S1/S2 is approximately equal to or larger than 0.06 where P is a pressure of the rare gas at room temperature in atms, S1 is a cross-sectional area in $mm^2$ of an area of the discharge space at its greatest internal diameter, and S2 is a cross-sectional area in $mm^2$ of material forming the arc tube located at a portion of greatest internal diameter of the arc tube.

7. The discharge lamp of claim 6, wherein the rare gas includes xenon and the metal halide includes scandium iodide and sodium iodide.

8. A metal halide lamp, comprising:

an arc tube having a discharge space including substantially no mercury;

a pair of electrodes projecting in such a manner as to face each other in the discharge space within the arc tube, a substantially cylindrical arc capable of being generated between ends of the pair of electrodes;

a buffer gas serving as a starter gas and including xenon at a pressure of between approximately 7 to 20 atms at room temperature located in the discharge space;

one of sodium halide, scandium halide, and a compound of sodium halide and scandium halide located in the discharge space; and a low melting point metal halide with a melting point less than or equal to approximately 400° C. located in the discharge space.

9. The metal halide lamp of claim 8, wherein the arc tube has an internal diameter within a range of approximately 0.6 mm to 1.7 mm larger than a diameter of the arc between the ends of the electrodes, and the electrodes protrude into the discharge space to a length of approximately 1.0 mm to 1.7 mm.

10. The metal halide lamp of claim 9, wherein the low melting point metal halide includes at least one of indium halide, gallium halide, and tin halide.

11. The metal halide lamp of claim 9, wherein the ionizing potential of the low melting point metal halide is approximately 5.5 eV to 6.5 eV.

12. The metal halide lamp of claim 11, wherein the low melting point metal halide comprises at least one of indium halide, gallium halide and tin halide.

13. The metal halide lamp of claim 9, wherein a mole content ratio of sodium halide to scandium halide is approximately 1.0 to 15, and a ratio of mole content of the low melting point metal halide to the scandium halide is in a range of approximately 0.1. to 10.

14. The metal halide lamp of claim 13, wherein the low melting point metal halide includes one of indium halide, gallium halide and tin halide.

15. The metal halide lamp of claim 13, wherein the ionizing potential of the low melting point metal halide is approximately 5.5 eV to 6.5 eV.

16. The metal halide lamp of claim 15, wherein the low melting point metal halide includes one of indium halide, gallium halide, and tin halide.

17. A metal halide lamp, comprising:

an arc tube having a discharge chamber including substantially no mercury;

a pair of electrodes projecting in such a manner as to face each other in the discharge space within the arc tube, with a substantially cylindrical arc capable of being generated between ends of the pair of electrodes;

a buffer gas serving as a starter gas located in the discharge space and including xenon at a pressure of approximately 7 to 20 atms at room temperature;

one of sodium halide, scandium halide and a compound of sodium halide and scandium halide located in the discharge space; and a low melting point metal halide with a melting point less than or equal to approximately 400° C. located in the discharge space, wherein an internal diameter of the arc tube is within a range of approximately 0.6 mm to 1.7 mm larger than a diameter of the arc between the ends of the electrodes, and the electrodes protrude into the discharge space a length of approximately 1.0 mm to 1.7 mm, a mole content ratio of sodium halide to scandium halide is approximately 1.0 to 15, and a mole content ratio of the low melting point metal halide to the scandium halide is in a range of approximately 0.5 to 3.0.

18. The metal halide lamp of claim 17, wherein the low melting point metal halide includes one of indium halide, gallium halide and tin halide.

19. A metal halide lamp of claim 17, wherein the ionizing potential of the low melting point metal halide is approximately 5.5 eV to 6.5 eV.

20. The metal halide lamp of claim 19, wherein the low melting point metal halide includes one of indium halide, gallium halide and tin halide.

21. A metal halide lamp, comprising:

an arc tube having a discharge chamber including substantially no mercury;

a pair of electrodes projecting in such a manner as to face each other in the discharge space within the arc tube, with a substantially cylindrical arc capable of being generated between ends of the pair of electrodes;

a buffer gas serving as a starter gas located in the discharge space and including xenon at a pressure of approximately 7 to 20 atms at room temperature;

one of sodium halide, scandium halide and a compound of sodium halide and scandium halide located in the discharge space; and a low melting point metal halide with a melting point less than or equal to approximately 400° C. located in the discharge space, wherein an internal diameter of the arc tube is within a range of approximately 0.6 mm to 1.7 mm larger than a diameter of the arc between the ends of the electrodes, and the electrodes protrude into the discharge space a length of approximately 1.0 mm to 1.7 mm, and a mole content ratio of sodium halide to scandium halide is approximately 1.0 to 15.

* * * * *

UNITED STATES PATENT AND TRADEMARK OFFICE

CERTIFICATE OF CORRECTION

PATENT NO. : 6,724,145 B1
DATED : April 20, 2004
INVENTOR(S) : Masaaki Muto et al.

It is certified that error appears in the above-identified patent and that said Letters Patent is hereby corrected as shown below:

Column 1,
Line 60, delete the word “Lit”.

Column 4,
Line 66, after “output” insert -- was --.

Column 5,
Line 25, replace “high-desity” with -- high-density --.

Column 6
Line 56, delete “H e”.

Column 8,
Line 35, delete “d)”.

Column 9,
Line 52, delete “Li”.

Column 11,
Line 27, replace “scandiun” with -- scandium --.

Column 13,
Line 49, delete “.” after “C”.

Column 14,
Line 27, delete “.” after “C”.
Line 48, delete “.” after “0.1”.

Column 15,
Line 5, delete “.” after “C”

UNITED STATES PATENT AND TRADEMARK OFFICE

CERTIFICATE OF CORRECTION

PATENT NO. : 6,724,145 B1
DATED : April 20, 2004
INVENTOR(S) : Masaaki Muto et al.

It is certified that error appears in the above-identified patent and that said Letters Patent is hereby corrected as shown below:

Column 16,
Line 16, delete "." after "C".

Signed and Sealed this

Twenty-third Day of November, 2004

JON W. DUDAS
*Director of the United States Patent and Trademark Office*